United States Patent [19]

Miller

[11] 4,410,176

[45] Oct. 18, 1983

[54] FULL BODY WEIGHT FRACTION DEVICE

[75] Inventor: Jack V. Miller, Sierra Madre, Calif.

[73] Assignee: Gravity Guidance, Inc., Pasadena, Calif.

[21] Appl. No.: 291,064

[22] Filed: Aug. 7, 1981

[51] Int. Cl.[3] ..... A63B 17/00

[52] U.S. Cl. ..... 272/145; 297/326; 297/457

[58] Field of Search ..... 272/62, 142, 144, 145, 272/33 R; 128/71, 75; 297/326, 457

[56] References Cited

U.S. PATENT DOCUMENTS

| | | | |
|---|---|---|---|
| 1,693,810 | 12/1928 | Daniels et al. | 272/144 X |
| 1,904,039 | 4/1933 | Bruder | 272/144 X |
| 3,152,802 | 10/1964 | Heisler et al. | 272/33 R |
| 3,380,447 | 4/1968 | Martin | 272/62 |
| 3,716,231 | 2/1973 | Martin | 272/144 |

*Primary Examiner*—Richard J. Apley

*Assistant Examiner*—Stephen Crow

*Attorney, Agent, or Firm*—Zarley, McKee, Thomte, Voorhees & Sease

[57] ABSTRACT

A tilt bed exercise device for rotating a human into inverted posture is provided with a pair of pivot bearings holding a rotatable tilt bed comprising a human torso conforming support with a beam extending therefrom and terminating in a rail canted at an angle wherein the proximal end of the rail is anterior of the user's ankles and the distal end is posterior to the user's ankles. A foot supporting means is slidably attached to the canted rail with selectable fixed locations suitable for different size humans. The user's ankles are held by supporting means including a hook on each ankle support engageable with the foot supporting means. A pivot stop is provided for the tilt bed wherein the foot supporting means is rotated past the vertical plane through the axis of the pivot bearings.

18 Claims, 11 Drawing Figures

FULL BODY WEIGHT FRACTION DEVICE

BACKGROUND OF THE INVENTION

This invention relates to exercise devices for rotating a human user in oscillation and into inverted posture. This type of device is known and is described in U.S. Pat. No. 3,707,285 (Martin), U.S. Pat. No. 3,716,231 (Martin) and U.S. Pat. No. 4,232,662 (Barber). Ankle holding devices are also known and are described in U.S. Pat. No. 3,380,447 (Martin) and my co-pending application, Ser. Nos. 203,707 and 203,336.

The currently known configurations of tilt beds are subject to problems related to the size (and hence weight) of the user. When currently known tilt beds are fully inverted with a user, the foot supporting means passes across the vertical plane through the pivot bearings where the center of gravity of the combined user and tilt bed structure are far enough past the pivot bearings to securely hold the user in inverted posture. The foot supporting means on such known devices are adjustably mounted on a straight rail wherein a larger user is supported when inverted from a point further past the pivot bearing plane than a smaller person. As a result of this inherent geometry a taller (and hence heavier) person tends to lock more solidly into the inverted orientation, and a shorter (and hence lighter) person has difficulty staying inverted. This is a serious shortcoming, since there is some tendency towards panic if the tall user has difficulty in getting out of the inverted posture, and the device is obviously useless to a small person who cannot stay inverted.

SUMMARY OF THE INVENTION

This invention provides a tilt bed exercise device in which users of any size can achieve inverted posture and can also get out of inverted posture with ease.

The structure of a tilt bed must be such that it can support the human body sufficiently close to the center of gravity that the user can oscillate the bed and get into inverted posture by only using arm movements. This means that the bed alone has a rather strong tendency to right itself from inverted orientation, since the bed structure supporting the human torso is posterior to the torso, and therefore the center of gravity of the bed is also posterior to the pivot axis. When not supporting a human the bed is strongly self-erecting, and becomes substantially neutral with the addition of the user's center of gravity anterior to the the pivot axis. By shifting the weight of the arms, the user may alter the combined center of gravity to be entirely anterior to the pivot axis, and thereby achieve inversion.

An object of the invention is to have the ability to control the shifting of the combined center of gravity of the bed and users of varying physical size.

Another object of the invention is to provide a tilt bed in which substantially all users can achieve inverted posture and can recover from inverted posture with similar ease.

The objects of the invention are achieved by providing a tilt bed in which users of various sizes, when in inverted posture, have substantially the same torsional moment applied against a rotational limit stop.

DETAILED DESCRIPTION OF THE DRAWINGS

Figure 1:
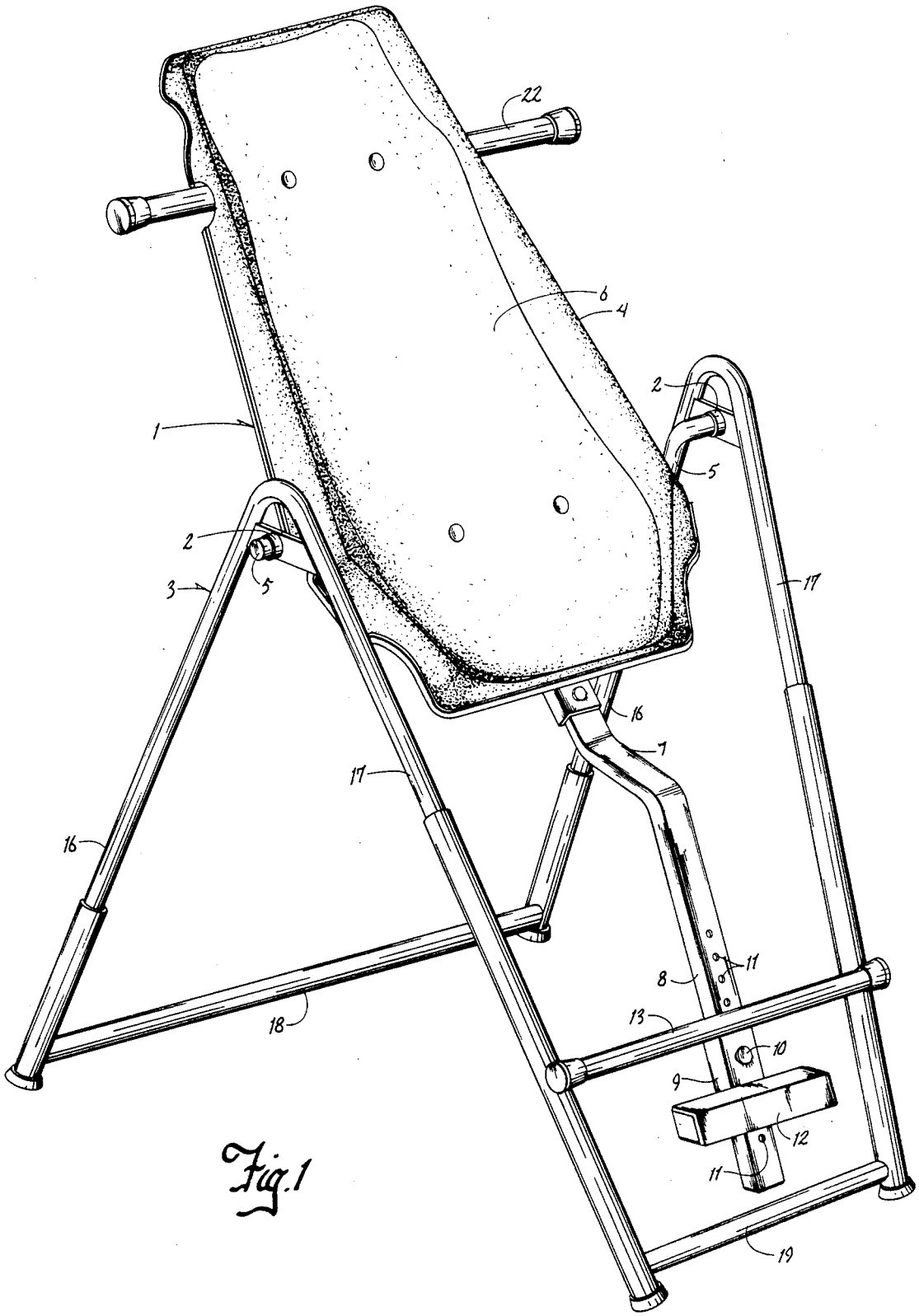
FIG. 1 is a perspective view of a full body weight traction device according to the invention.

In FIG. 1 a full body weight traction device 1 is shown having pivot bearings 2 supported by a frame structure 3. A tilt bed 4 is supported within pivot bearings 2 on bearing journals 5 at approximately the longitudinal mid-point of tilt bed 4. Tilt bed 4 includes a torso support 6, which is sized and configured to generally match the size and shape of a human torso. A beam 7 extends from the lower central portion of torso support 6 and terminates in a canted rail section 8, on which a foot support 9 is slidably disposed. A lock 10 is provided to engage any of a series of discrete adjustment stops 11 in order to locate the foot support 9 properly for users of different sizes. The foot support 9 is provided with a foot rest 12 and a foot bar 13. Pivot bearings 2 are held in co-axial relationship parallel to a floor surface by a pair of posterior legs 16 a pair of anterior legs 17. A cross brace 18 joins the lower extremity of each leg 16 at a width greater than the distance between pivot bearings 2, and a cross brace 19 joins the extremity of each leg 17 at a width less than the distance between pivot bearings 2. A stop bar 22 is provided with a length greater than the transverse distance between the anterior legs 17 and less than the transverse distance between the posterior legs 16, whereby upon rotation of the tilt bed the stop bar will pass through legs 16 and stop on legs 17.

Figure 2:
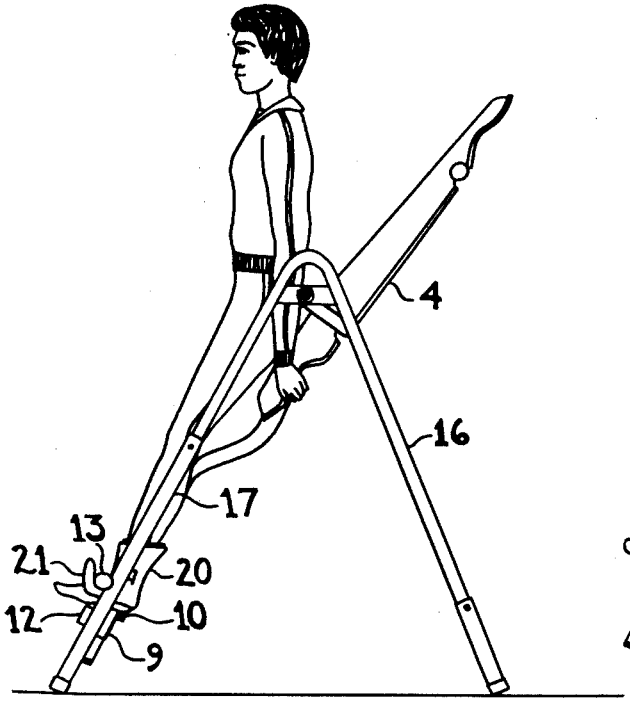
FIG. 2 is side elevation view of the tilt bed of FIG. 1 showing a user is generally upright posture.

In FIG. 2 a user is shown in the tilt bed 4 with foot support 9 adjusted by lock 10 for the approximate height of the user. The users feet are resting on foot rest 12, with the metatarsal arch disposed between foot rest 12 and foot bar 13. Clamped about the user's ankles are ankle supporting devices 20 which are provided with hooks 21 partially enveloping foot bar 21 to prevent the user from falling in partial or fully inverted postures.

Figure 3:
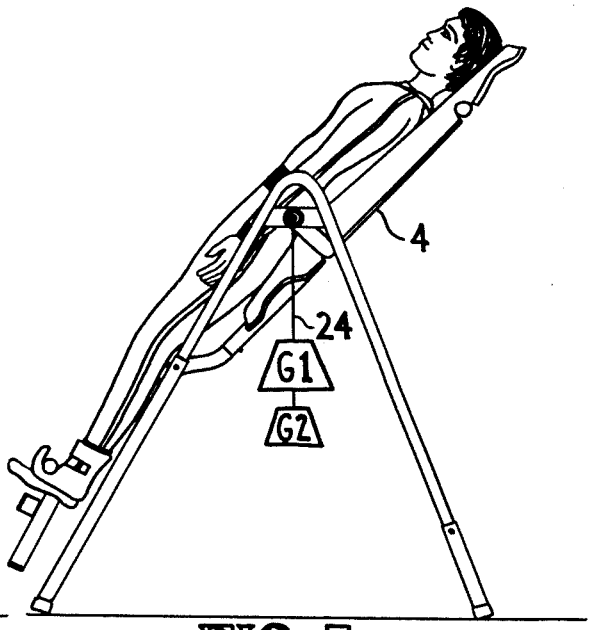
FIG. 3 is a side elevation view of the tilt bed and user of FIG. 2 in a neutral balanced orientation.

In FIG. 3 the user is resting on the tilt bed 4 in a neutral balanced condition wherein the center of gravity of the user, shown as $G_1$, and the center of gravity of the tilt bed, shown as $G_2$, are coincident and in the vertical plane through the pivot axis 24.

Figure 4:
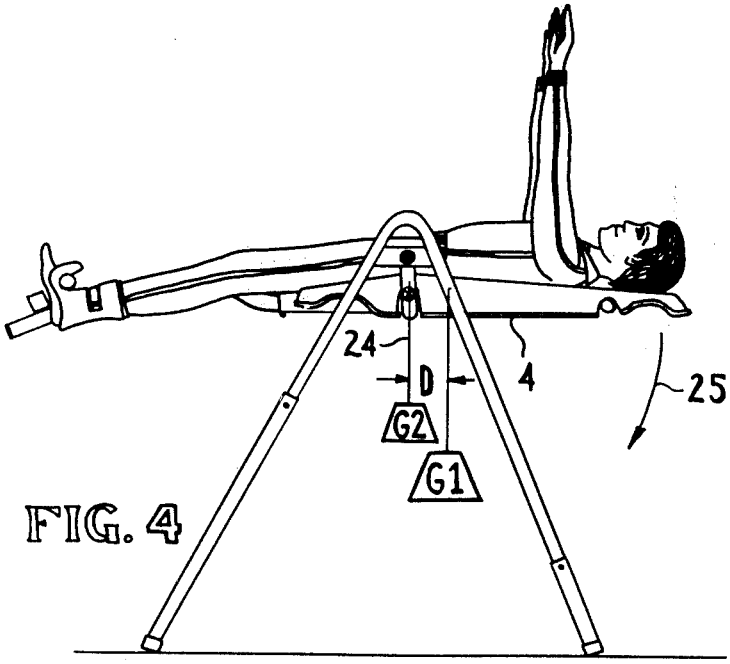
FIG. 4 is a side elevation view of the tilt bed and user of FIG. 2 in which the user is initiating rotation towards inverted posture.

In FIG. 4 the user is shown having raised his arms and thereby has shifted his center of gravity $G_1$ a distance D from the pivot axis plane 24, causing the tilt bed 4 and user to rotate in direction 25. In the orientation shown the tilt bed center of gravity $G_2$ remains approximately in the pivot axis plane 24.

Figure 5:
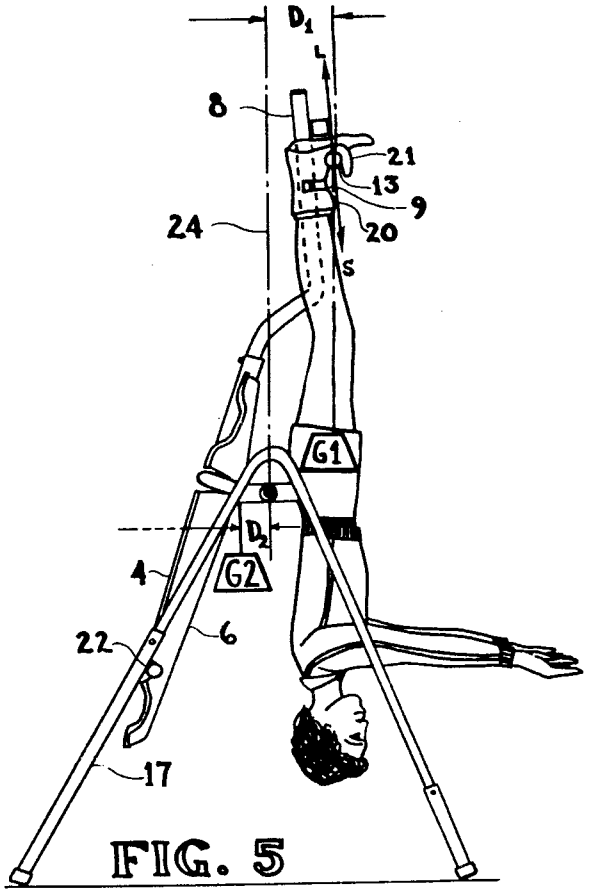
FIG. 5 is a side elevation view of the tilt bed and user of FIG. 2 in which inverted posture has been achieved.

In FIG. 5 the user is shown having rotated to a fully inverted posture wherein he is supported entirely by the engagement of the hooks 21 of ankle supporting devices 20 onto foot bar 13. At this point the user is completely free of the torso support 6 of tilt bed 4, and is prepared for stretching and exercising in inverted posture. The user's center of gravity $G_1$ is displaced a distance $D_1$ from the pivot axis plane 24 sufficiently to locate the stop bar 22 against the anterior legs 17. The center of gravity $G_2$ of the tilt bed 4 is displaced a small distance $D_2$ which provides a limited moment tending to rotate the bed to the erect position, but the product of $G_1$ times $D_1$, being greated then the product of $G_2$ times $D_2$ keeps the tilt bed and user fully in the inverted posture. If the user swings or pushes his body posteriorly towards the vertical plane of the pivot axis, $D_1$ may be reduced sufficiently to make the product of $G_1$ times $D_1$ less than the product of $G_2$ times $D_2$, and hence cause rotation to the upright posture. Since $G_2$ and $D_2$ are constant in the inverted position, then to maintain stability for user of various weights, ie: various values $G_1$, $D_1$ is varied inversely with $G_1$, keeping the product of $G_1$ times $D_1$ also approximately constant. In general, large people are heavier than small people. A person over 6 feet tall normally would weigh approximately 200 pounds, where a person under 5 feet tall would weigh approximately 100 pounds. Foot support 9 is adjustable along rail 8 along the canted line L-S. Near the extreme adjustment L for large persons $D_1$ is significantly smaller than near the extreme adjustment S for smaller persons. The angle of the canted rail 8 is sufficient to vary $D_1$ a factor of 2 over the adjustment range of line L-S, maintaining the balance within limits for nearly all user sizes, whereby nearly any user employing ankle supporting means 20 with the hooks 21 engaged upon the foot supporting bar 13 may exercise with considerable mobility without accidently releasing from inverted posture.

Figure 6:
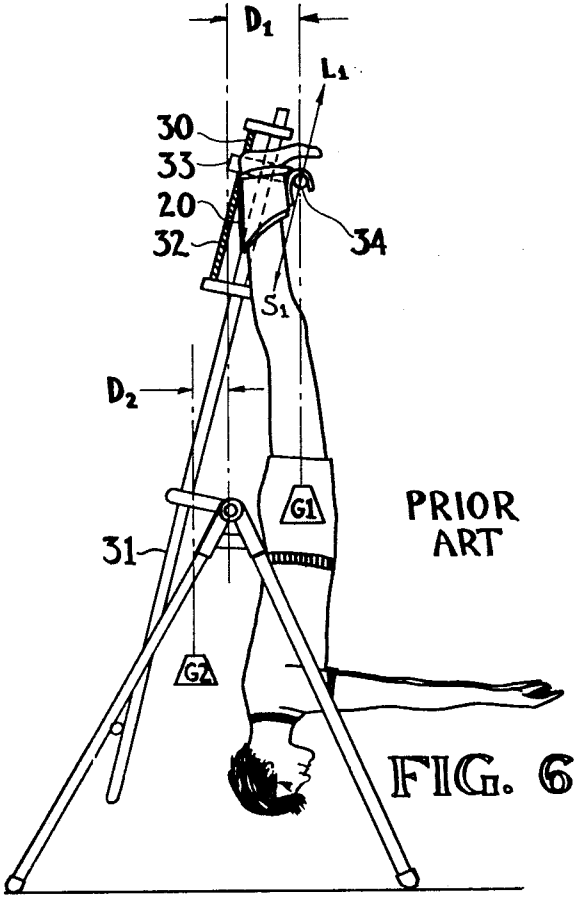
PRIOR ART FIG. 6
FIG. 6 is a side elevation view of a tilt bed of prior art and showing the range of adjustment for user size.

In FIG. 6 the geometry of prior art devices is shown, in which a beam 30 is a straight line extension of the structure of a prior art tilt bed 31. An adjustment means 32 is typically provided which adjusts a foot support 33 carrying a foot bar 34 along line $L_1$-$S_1$ to adjust for the difference in size of the users. With adjustment in direction $L_1$ there is a proportional increase in $D_1$ for users of greater weight. Conversely, with adjustment in direction $S_1$ there is a proportional decrease in $D_1$ for users of lesser weight. As a result, the product of $D_1$ times $G_1$ for a large person is much larger than for a smaller person. Since the product of $G_2$ times $D_2$ remains a constant, a large person has difficulty returning from inverted posture; and a smaller person sometimes cannot achieve inverted posture at all.

Figure 7:
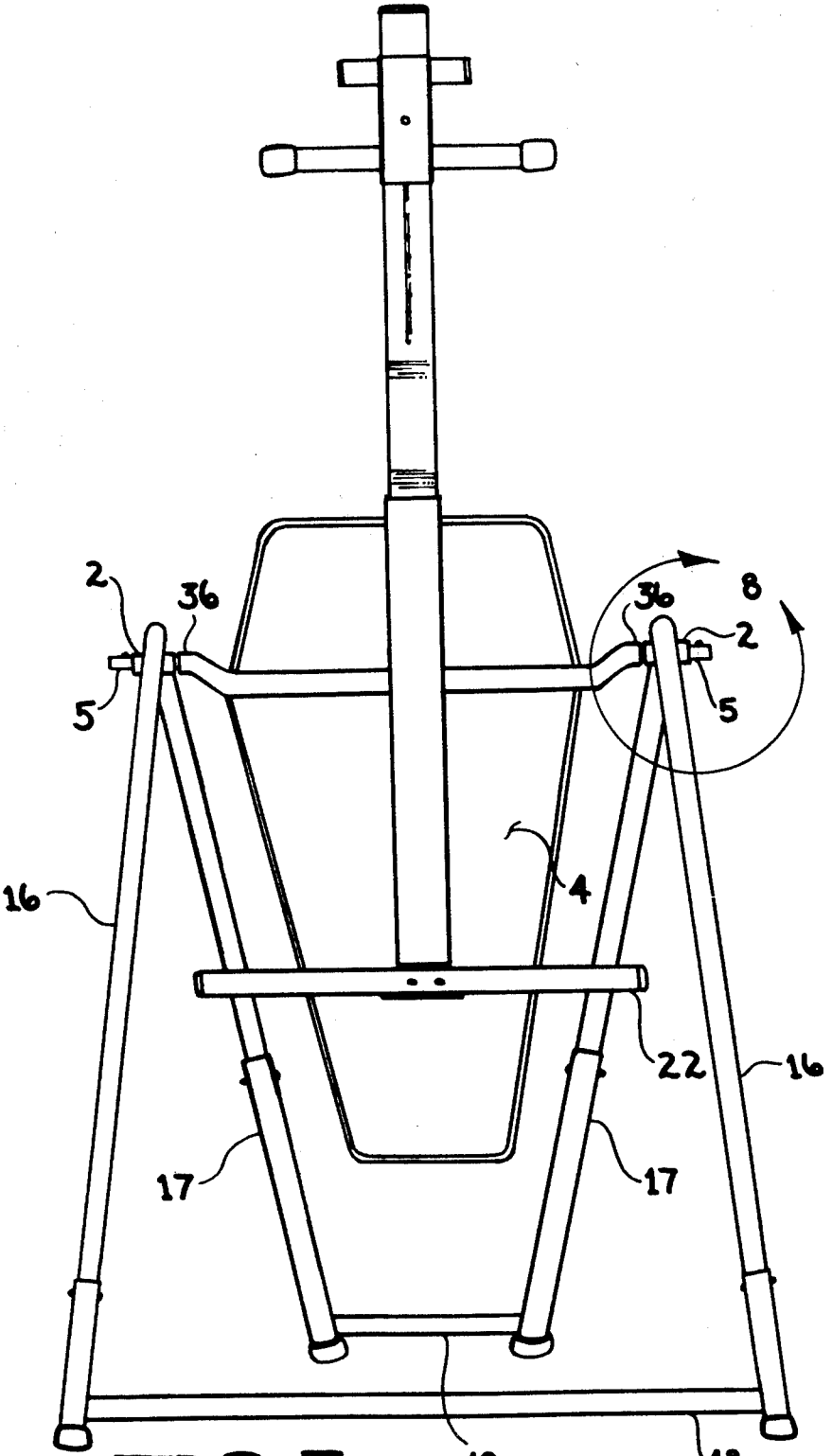
FIG. 7 is a front elevation view of a tilt bed of FIG. 1 showing partial sectional views of the pivot bearings.

In FIG. 7 the front elevation view of the tilt bed exercise device according to the invention, shows the tilt bed in the inverted position and the stop bar 22 having passed through the posterior legs 16 and resting against the anterior legs 17. Cross bars 18 and 19 support the respective legs and urge pivot bearings 2 against respective thrust portions 36 of journals 5.

Figure 8:
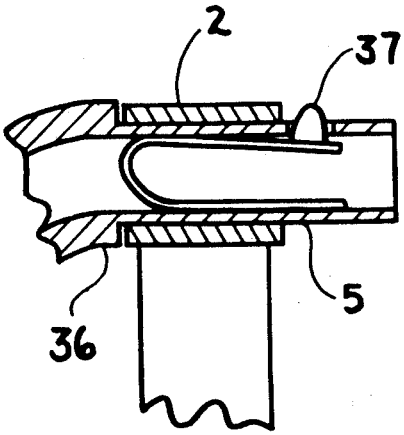
FIG. 8 is an enlarged view of a pivot bearing and journal in view 8 of FIG. 7.
Figure 7:
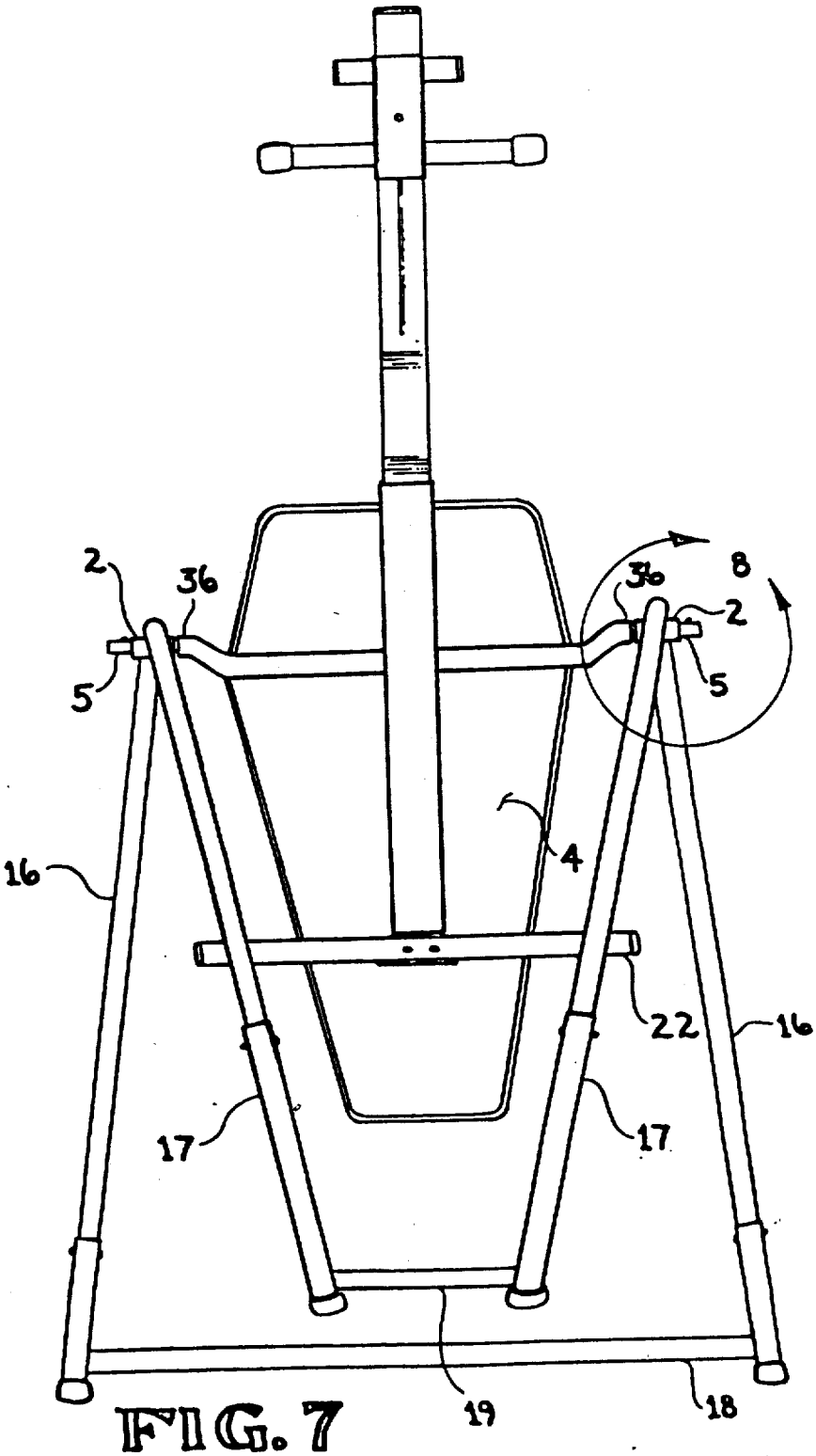

In FIG. 8 journal 5 is shown with pivot bearing 2 against thrust bearing 36, and having a spring lock 37 to prevent loss of engagement event the bearing thrust load is overcome.

Figure 9:
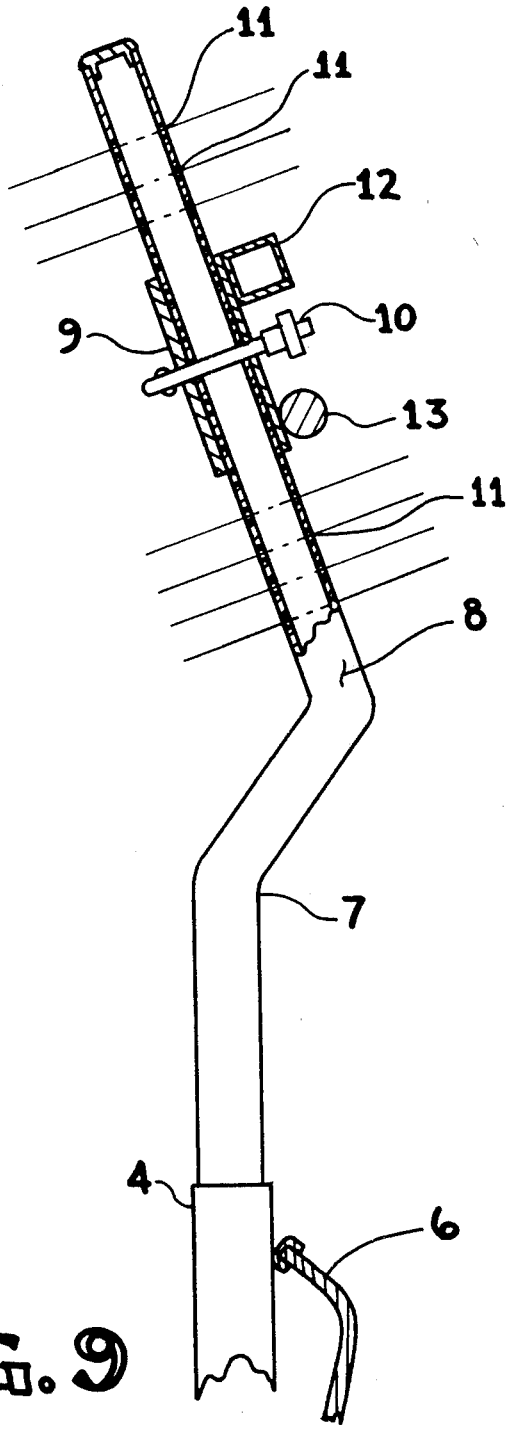
FIG. 9 is a side cross sectional view of the size adjustment mechanism of the tilt bed of FIG. 1.

In FIG. 9 beam 7 of tilt bed 4 is shown extending from torso support 6 in the inverted position. Rail 8 supports the foot support 9, in turn supporting foot rest 12 and foot bar 13. Foot support 9 is slidable on rail 8, and may be located along rail 8 by a locking pin 10 passing through at least one wall of rail 8 and one of a plurality of holes 11 in at least one wall of rail 8.

Figure 10:
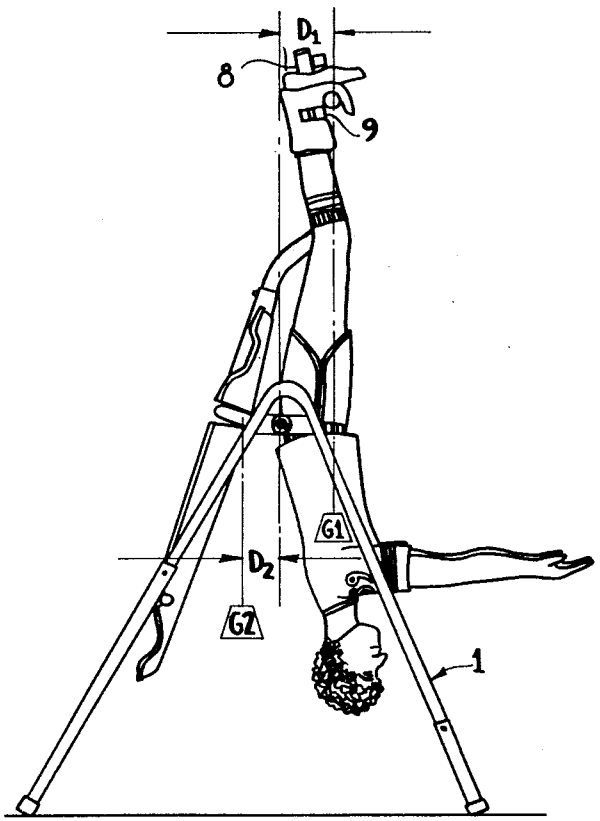
FIG. 10 is a side elevation view of the tilt bed according to the invention with a user of large size.

In FIG. 10 a user of large size is shown in inverted posture on the tilt bed exercise device 1 with foot support 9 adjusted to the distal end of rail 8, whereat distance $D_1$ is small and the product of $D_1$ times $G_1$ is only slightly greater than the product of $D_2$ times $G_2$, and the user is stable in inverted posture.

Figure 11:
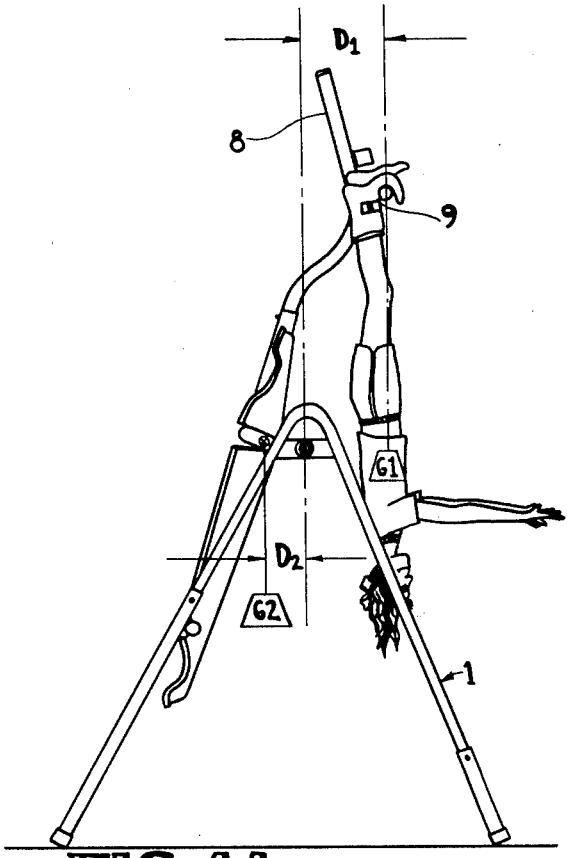
FIG. 11 is a side elevation view of the tilt bed according to the invention with a user of small size.

In FIG. 11 a user of small size is shown in inverted posture on the tilt bed exercise device 1 with foot support 9 adjusted to the proximal end of rail 8, whereat distance $D_1$ is large and the product of $D_1$ times $G_1$ is also slightly greater than the product of $D_2$ times $G_2$, and the user is stable in inverted posture.

The simplicity of the disclosed structure and adjustment system compared to the prior art devices results in a versatility of user size not previously available, and a reliability of getting into and returning from inverted posture that represents a dramatic improvement over the prior art.

I claim:

1. An exercise device comprising:

(a) a pair of spaced apart pivot bearings;

(b) means for supporting said pivot bearings in a coaxial relationship parallel to and spaced above a floor surface;

(c) a tilt bed disposed between said pivot bearings and pivotally mounted therein at its approximate midpoint, and having a human torso supporting means sized and configured generally to match the size and shape of a human torso, and an extension means extending longitudinally from the lower end of said torso supporting means;

(d) ankle holding means attached to said extension means for the secure attachment of a user's ankles to said tilt bed;

(e) a pivot stop means wherein said tilt bed supporting the user may be rotated to a stop position with said ankle holding means rotated past the vertical plane through the axis of said pivot bearings;

(f) adjustment means on said tilt bed which allows said ankle holding means to be selectively longitudinally positioned with respect to said pivot bearings so that said ankle holding means can be positioned over a range of locations relative to said vertical plane when said tilt bed is at said stop position, said range being from a fixed distal position wherein said ankle holding means is closest to said vertical plane through the axis of said pivot bearings to a fixed proximal position wherein said ankle holding means is farthest away from said vertical plane through the axis of said pivot bearings.

2. The device of claim 1 wherein said extension means comprises a gooseneck shaped rail extending from a proximal position to said torso supporting means to a distal position extending away from said torso supporting means, said rail having a proximal section attached directly to said torso supporting means and extending generally outwardly, a middle section extending generally forwardly and outwardly from said proximal section and a distal section extending generally rearwardly and outwardly from said middle section.

3. The device of claim 1 wherein said adjustment means comprises an ankle holding means position changing mechanism allowing said ankle holding means to be selectively mounted along a plurality of fixed positions along said extension means.

4. An exercise device as in claim 1 in which the means for supporting the pivot bearings is a frame having two anterior legs and two posterior legs wherein the anterior legs are closer spaced than the posterior legs and the stop means comprises a bar transverse to the torso supporting means, said bar being short enough to pass between the posterior legs and long enough to strike the anterior legs of the frame and stop the rotation of the bed.

5. An exercise device as in claim 1 in which the torso supporting means is a unitary plastic part which is contoured to generally conform to the curvature of the human back.

6. An exercise device as in claim 1 in which the pivotal mount of the tilt bed comprises a transverse bar passing under the torso supporting means and curving anteriorly to terminate at each end in a journal disposed within each respective pivot bearing.

7. An exercise device as in claim 6 in which the pivotal mount journals are provided with thrust flanges and the respective pivot bearings are inwardly biased against said thrust flanges.

8. An exercise device as in claim 7 in which the pivotal mount journals each extend through the respective pivot bearings and are provided with locking means resisting withdrawal of the journals from the respective bearings.

9. An exercise device as in claim 4 in which the two anterior legs are joined by a transverse bar at their distal ends, and the two posterior legs are also joined by a transverse bar at their distal ends, and said transverse bars bias the pivot bearings towards each other.

10. An exercise device as in claim 1 in which the beam extending from the torso supporting means is approximately centered between the pivot bearings.

11. An exercise device as in claim 1 in which the foot supporting means includes a horizontal bar on which a hook is engaged on each side of the canted rail, said hooks being fixed to an ankle supporting device clamped about each ankle of the user.

12. An exercise device as in claim 1 in which the foot supporting means comprises a structure at least partially encircling the ankles of the user.

13. An exercise device comprising:

(a) a pair of spaced apart pivot bearings;

(b) means for supporting said pivot bearings in a coaxial relationship parallel to and spaced above floor surface;

(c) a tilt bed disposed between said pivot bearings pivotally mounted therein at its approximate midpoint;

(d) a human torso supporting means on said tilt bed;

(e) an extension means extending from the lower end of said torso supporting means in a gooseneck like configuration;

(f) ankle support means movably attachable to said extension means;

(g) a pivot stop means wherein said tilt bed supporting user may be rotated to a stop position with said ankle supporting means rotated past the vertical plane through the axis of the pivot bearings;

(h) said extension means having a proximal section attached directly to said torso supporting means and when said bed is in said stop position extending generally outwardly, a middle section extending generally forwardly and outwardly from said proximal section, and a distal section extending generally rearwardly and outwardly from said middle section;

(i) said ankle support means movable on said extension member being selectively positionable at a plurality of fixed locations including a distal end fixed position and a proximal end fixed position, all said fixed locations, when said tilt bed is in a past-vertical inverted position, being located on the same side of said vertical plane as that of the center of gravity of said user and on the opposite side of said vertical plane of the center of gravity of said tilt bed, all said fixed locations being generally positioned such that when said tilt bed is in a past-vertical inverted position said proximal end fixed position is the farthest distance from vertical plane through the axis of said pivot bearings, whereas said distal end fixed position is nearest to said vertical plane through the axis of said pivot bearings with all other fixed positions existing generally along a line between said proximal and fixed position and said distal end fixed position.

14. An exercise device comprising, a pair of spaced apart pivot bearings, a frame for supporting said pivot bearings in a coaxial relationship parallel to and spaced above a floor surface, said frame having two anterior legs and two posterior legs wherein the anterior legs are spaced closer than the posterior legs, a tilt bed disposed between said pivot bearings and pivotally mounted therein at its approximate midpoint;

a beam extending from the lower end of said tilt bed terminating in an elongated rail adapted to be disposed between the ankles of a user;

a foot supporting means attached to said rail; and a pivot stop bar transversely connected to said tilt bed, said bar being short enough to pass between said posterior legs and long enough to strike said anterior legs of said frame and stop rotation of said tilt bed whereby said tilt bed supporting a user may be rotated to a stop position with said foot supporting means rotated past the vertical plane through the axis of said pivot bearings.

15. An exercise device as in claim 14 further comprising a human torso supporting means on said tilt bed sized and configured generally to match the size and shape of a human torso and a foot supporting means attached to said rail.

16. An exercise device as in claim 15 in which said anterior legs have forward and rearward sides whereby said tilt bed can be rotated from an initial upright position in which said foot supporting means engages said forward sides of said anterior legs to a final inverted position in which said pivot stop bar passes beyond the vertical plane through the axis of the pivot bearings and engages said rearward side of said interior legs.

17. An exercise device as in claim 14 wherein said beam is canted at an angle wherein the proximal end thereof is anterior of the user's ankles and the distal end is posterior to the user's ankles.

18. An exercise device comprising:

(a) a pair of spaced apart pivot bearings;

(b) means for supporting said pivot bearings in a coaxial relationship parallel to and spaced above floor suface;

(c) a tilt bed disposed between said pivot bearings pivotally mounted therein at its approximate midpoint;

(d) a human torso supporting means on said tilt bed;

(e) an extension means extending from the lower end of said torso supporting means in a gooseneck like configuration;

(f) ankle support means movably attachable to said extension means;

(g) a pivot stop means wherein said tilt bed supporting user may be rotated to a stop position with said ankle supporting means rotated past the vertical plane through the axis of the pivot bearings;

(h) said extension means having a proximal section attached directly to said torso supporting means and when said bed is in said stop position extending generally outwardly, a middle section extending generally forwardly and outwardly from said proximal section, and a distal section extending generally rearwardly and outwardly from said middle section;

said means for supporting said pivot bearings includes a frame having two anterior legs and two posterior legs wherein the anterior legs are spaced closer than the posterior legs, and said pivot stop means being a bar extending transversly of said tilt bed and being short enough to pass between said posterior legs and long enough to strike said anterior legs of said frame and stop rotation of said tilt bed whereby said tilt bed supporting a user may be rotated to a stop position with said ankle holding means rotated past the vertical plane through the axis of said bearings.

* * * * *

UNITED STATES PATENT AND TRADEMARK OFFICE

CERTIFICATE OF CORRECTION

PATENT NO. : 4,410,176

DATED : October 18, 1983

INVENTOR(S) : Jack V. Miller

It is certified that error appears in the above-identified patent and that said Letters Patent is hereby corrected as shown below:

In the title, "FRACTION" should read -- TRACTION --.

Fig. 7 should appear as shown on the attached page.

Signed and Sealed this

*Eighth* Day of *May 1984*

[SEAL]

*Attest:*

GERALD J. MOSSINGHOFF

*Attesting Officer*

*Commissioner of Patents and Trademarks*

Patent No. 4,410,176 October 18, 1983

Jack V. Miller